US011896170B2

(12) United States Patent
Steele

(10) Patent No.: US 11,896,170 B2
(45) Date of Patent: Feb. 13, 2024

(54) PACKAGE HAVING AN OUTWARD EXTENDING RECLOSURE DEVICE

(71) Applicant: Mark Steele, New Prague, MN (US)

(72) Inventor: Mark Steele, New Prague, MN (US)

( * ) Notice: Subject to any disclaimer, the term of this patent is extended or adjusted under 35 U.S.C. 154(b) by 0 days.

(21) Appl. No.: 17/827,772

(22) Filed: May 29, 2022

(65) Prior Publication Data

US 2022/0287518 A1 Sep. 15, 2022

Related U.S. Application Data

(63) Continuation of application No. 16/518,849, filed on Jul. 22, 2019, now Pat. No. 11,350,802.

(60) Provisional application No. 62/701,077, filed on Jul. 20, 2018.

(51) Int. Cl.

| | |
|---|---|
| ***A47K 10/42*** | (2006.01) |
| ***B65D 75/30*** | (2006.01) |
| ***B65D 85/62*** | (2006.01) |
| ***B65D 75/58*** | (2006.01) |
| *A47K 10/32* | (2006.01) |

(52) U.S. Cl.

CPC ..... *A47K 10/421* (2013.01); *B65D 75/30* (2013.01); *B65D 75/5827* (2013.01); *B65D 85/62* (2013.01); *A47K 2010/3266* (2013.01)

(58) Field of Classification Search

CPC ..... A47K 2010/3266; A47K 10/421; A47K 10/24; A47K 2010/3246; B65D 85/62; B65D 75/5827; B65D 75/30; B65D 75/26; B65D 75/28

USPC ..... 206/397, 389, 554, 449; 229/237, 207; 383/207, 208, 64, 63, 210

See application file for complete search history.

(56) References Cited

U.S. PATENT DOCUMENTS

| | | | | |
|---|---|---|---|---|
| 4,252,238 A * | 2/1981 | Spiegelberg | B65D 33/2508 | 206/274 |
| 4,923,309 A * | 5/1990 | VanErden | B65D 33/2533 | 53/410 |
| 4,925,316 A * | 5/1990 | Van Erden | B65D 33/20 | 383/210 |
| 5,725,312 A * | 3/1998 | May | B65D 33/2541 | 383/210.1 |
| 2010/0247003 A1* | 9/2010 | Huffer | B65D 75/5855 | 383/207 |
| 2014/0056545 A1* | 2/2014 | Fish | B65D 33/007 | 156/66 |

* cited by examiner

*Primary Examiner* — Rafael A Ortiz

(74) *Attorney, Agent, or Firm* — Skaar Ulbrich Macari, P.A.

(57) ABSTRACT

A package or pouch comprising one or more panel portions and a reclosure device. The reclosure device is provided to extend outward from a panel portion of the package to facilitate the use of the package to store and dispense wet wipes and like products.

19 Claims, 11 Drawing Sheets

103
112a, 114a
102
103 (edge)
Closure outside package
115
110
103 (edge)
110
22-22

120
124
132
130
130
122
C
122
120
Closure Material
142
140
144
146
22
22
103

Zipper Seal
112, 114
115
103

PACKAGE HAVING AN OUTWARD EXTENDING RECLOSURE DEVICE

PRIORITY

This Application is a continuation of U.S. patent application Ser. No. 16/518,849, filed Jul. 22, 2019, which claims priority to and the benefit of U.S. Provisional Patent Application No. 62/701,077, filed Jul. 20, 2018; with each of the referenced applications and disclosures fully incorporated herein by reference.

FIELD

The present invention relates generally to packaging and, more particularly, to packages, and methods for manufacturing and using packages or pouches, having a reclosure device, such as a zipper, extending outward from the package.

BACKGROUND

There are many options already available for flexible packages with recloseable devices, but some products are presented in a way where the current available packaging options are inadequate. One of these products is wet or moist wipes. These products typically require a high oxygen and moisture barrier package where the wipes can be easily dispensed from a pre-folded and pre-wetted stack. The current flexible packages used for these types of products will typically incorporate a label over a precut panel of the package. The label is larger than the precut panel so the user can peel the label back, which has the portion of the precut panel adhered to it. The user can then take the required amount of wipes and place the label back over the opening. The problem with this type of closure is the package material can become wrinkled when replacing the label, especially as more and more wipes are used, and because the package is much larger than the remaining product it is containing. These wrinkles can let air into the package which can cause the wipes to dry out before they are all used. Further, as a considerable amount of the product has been used, there is a lot of air that can get into the package and the package and label can easily become misaligned when trying to press the label down with the extra packaging material. This leads to frustration on the consumer's part as they know the wipes will soon dry out and be of no use. The adhesive on the label can also become contaminated with the products contained in the wipes which, over time, will also compromise the closure seal and further lead to drying out of the product.

The best package format for these types of products (e.g., wet wipes) are pillow pack or fin seal pouches typically run on a flow wrapper, which are typically the style including the referenced pre-cut panel and adhesive/label for access. As described, these types of packages do not include recloseable zippers. There have been some fin seal packages designed with zippers, however, the zipper is located near the end of the package so you can pinch the zipper closed with no product between your fingers and the mating fasteners. This again does not allow for the consumer to peel a wipe from the top of the stack and creates more wasted packaging material. Alternatively, an Inno-Lok style zipper can be placed in the center of the panel. However, to close the zipper the consumer has to press downward against the product, which makes it difficult to line up the mating portions of the zipper and lock them together.

The inherent problem with attempting to make a package like this, is the ability to attach the zipper to the package material without having any leaks around the seal of the zipper and the package. There have been other designs for zippers protruding from a package panel, but they are not provided in a way as to retain the oxygen and moisture barrier needed.

As detailed above, simply using a recloseable zipper, either press-to-close or a slider zipper, does not work well for these products as they have been typically placed on the end or top of the package. Again, wet wipes are placed in a stack and should be pulled from the stack one at a time. Having a recloseable zipper on the end of the package does not easily allow the consumer to take a wipe from the top of the stack. The wipes can be placed within this type of package so the top of the stack is toward the end or top of the package with a zipper, but the package does not fit the shape of the stack well. This can introduce other issues, like the inability to stack the packages in shipping containers or on store shelves without wrinkling the packaging film. This is very undesirable from a cost and marketing perspective. There is also a lot of wasted space within this style of package, which not only adds cost, but allows for more air to remain in the package—which can contribute to the product drying out before they are all used.

Currently, some packaging solutions used to contain and dispense baby wipes and like products include expensive hinged and ridged plastic closures that are attached to a flexible package. These rigid hinged closures are very expensive and are not very airtight and will only keep the wipes inside the package wet for a limited period of time, and the user cannot always determine if they have closed them all the way. If they have not, the wipes dry out even sooner.

As a result, there is a need for a package that substantially solves the above-referenced problems with conventional package and closure designs, configurations, and manufacturing methods.

SUMMARY

Embodiments of the present invention include a pouch or package (e.g., flexible package) having an extending or protruding reclosure or recloseable device (e.g., zipper). The reclosure device can protrude out from and above a top panel of a pillow style package (e.g., via a slot or opening), where the consumer can open and close the device like they would on any other pouch. This can allow the product to be presented in a pillow or fin seal style pouch, which fits the product the best, and would solve all the other issues described with conventional closure options.

With various embodiments, the reclosure device, such as a press-to-close zipper or a slider zipper, is adhered to a strip of sealable barrier or non-barrier material—e.g., an extending flange member. This device, made to particular specifications in size and material type, is prepared and applied to the package such that one or more flange sections or members are folded within the package for sealing to an internal surface of a package panel portion, with the reclosure device and its interlocking members extending out externally from the panel for use. The foldable flange members sealed to the internal surface of the package panel can be thinner and/or more flexible than the flange sections having one or more locking members (e.g., male and female locking members). In other embodiments, the flanges themselves can be constructed of a thinner or more flexible material than traditional flanges and directly sealed to the inner surface of the package panel.

Other embodiments of the invention can include the reclosure device provided or sealed behind or under a portion of the package (e.g., a panel portion) such that the package includes a pre-perforated material patch or section that can be removed by the user. The user can then pull the reclosure device out from behind the package material to extend outward from the package for use. Other means of accessing or concealing the reclosure device at or within the package can be employed without deviating from the spirit and scope of the present invention.

The above summary is not intended to describe each illustrated embodiment, claimed embodiment or implementation of the invention. The detailed technology and preferred embodiments implemented for the subject invention are described in the following paragraphs accompanying the appended drawings for people skilled in this field to well appreciate the features of the claimed invention. It is understood that the features mentioned hereinbefore and those to be commented on hereinafter may be used not only in the specified combinations, but also in other combinations or in isolation, without departing from the scope of the present invention.

BRIEF DESCRIPTION OF THE DRAWINGS

The invention may be more completely understood in consideration of the following detailed description of various embodiments of the invention in connection with the accompanying drawings, in which.

Figure 3:
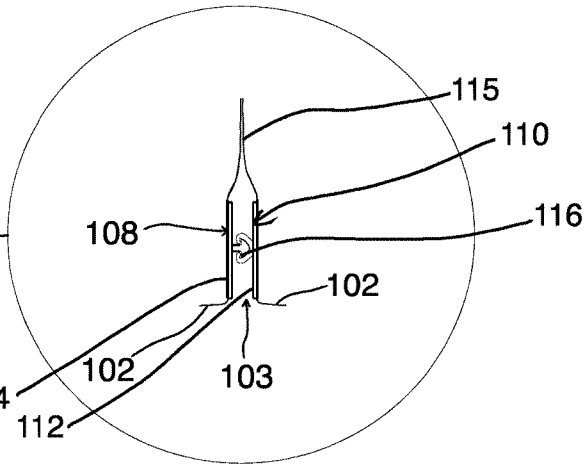
FIGS. 1-3 show a package having an extended or protruding reclosure device along a portion of a fin seal, in accordance with embodiments of the present invention.
Figure 2:
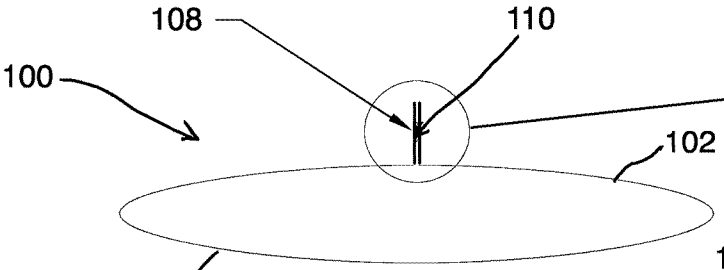
Figure 1:
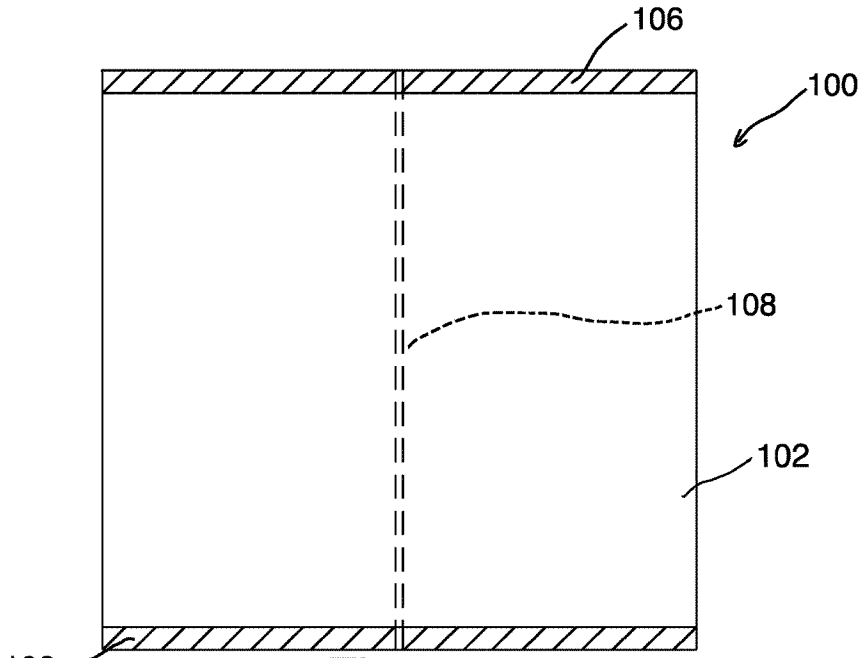
Figure 6:
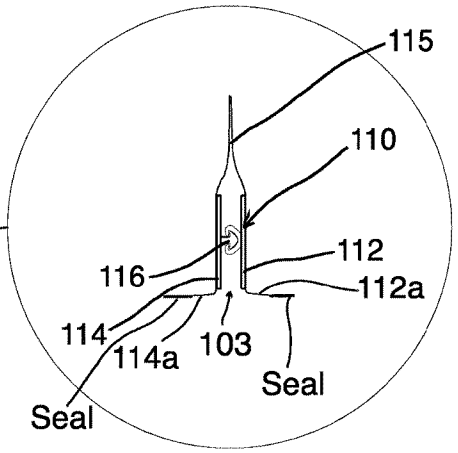
FIGS. 4-6 show a package having an extended or protruding reclosure device opposite a fin seal, in accordance with embodiments of the present invention.
Figure 5:
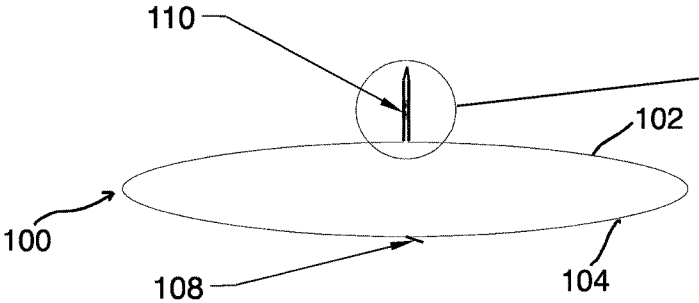
Figure 4:
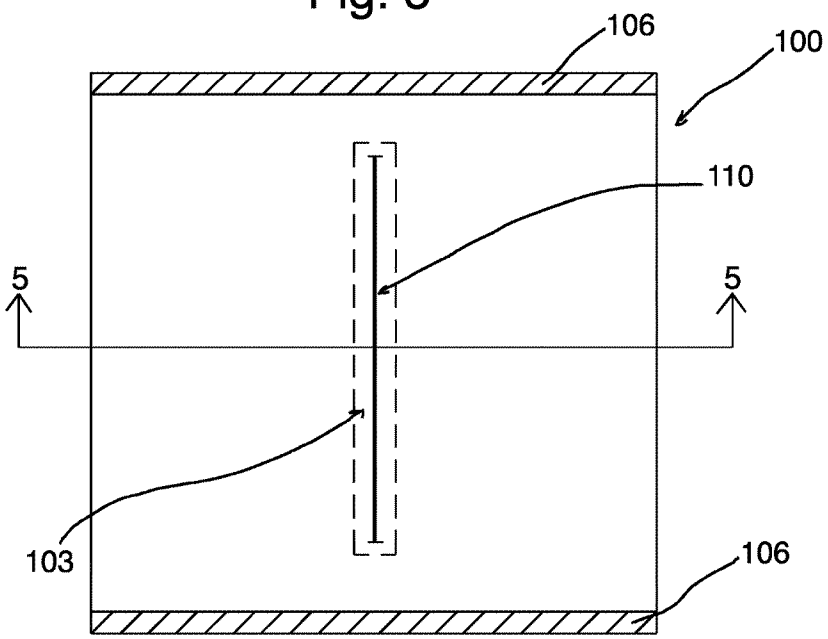
Figure 9:
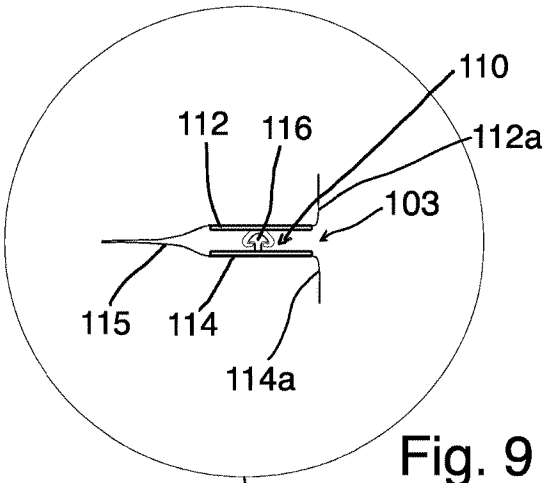
FIGS. 7-9 show a package having an extended or protruding reclosure device transverse to a fin seal, in accordance with embodiments of the present invention.
Figure 8:
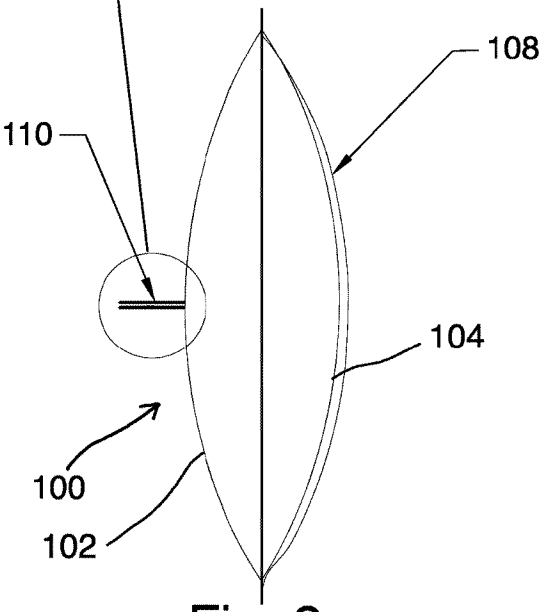
Figure 7:
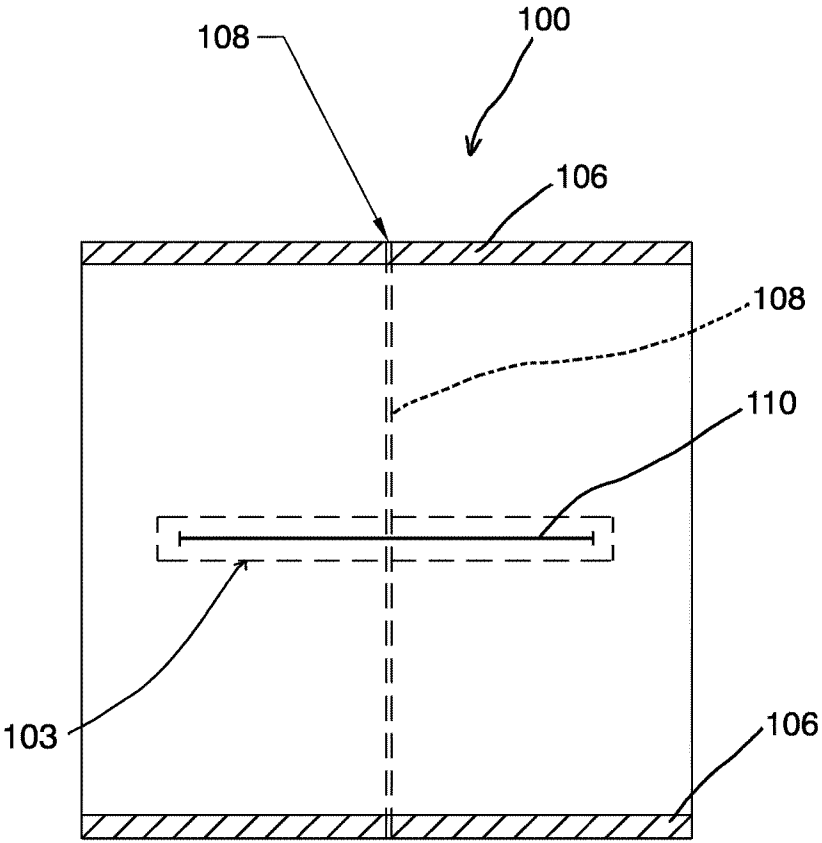

While the invention is amenable to various modifications and alternative forms, specifics thereof have been shown by way of example in the drawings and will be described in detail. It should be understood, however, that the intention is not to limit the invention to the particular embodiments described. On the contrary, the invention is to cover all modifications, equivalents, and alternatives falling within the spirit and scope of the invention as defined by the appended claims. For illustrative purposes, hatching or shading in the figures is generally provided to demonstrate sealed or crushed portions and/or integrated devices for the package.

DETAILED DESCRIPTION OF THE INVENTION

Referring generally to FIGS. 1-36*c*, packages or pouches 100 (e.g., flexible) and methods of manufacturing, formation, and use are shown in accordance with embodiments of the present invention.

As shown in FIGS. 1-9, the pouch or package 100 can include one or more panel portions 102, 104, one or more end seals 106, a fin, lap, or like seal 108, and one or more recloseable or reclosure devices 110. The reclosure device 110 is provided to extend outward from a panel portion of the package 100, such as panel portion 102. In various embodiments, the reclosure device 110 protrudes out and above a top panel of a pillow style package such that a consumer or user can open and close the device like they would on any other pouch. This allows the product to be presented in a pillow or fin seal style pouch, which best stores and dispenses stacked wet wipes/towelettes and similar products.

The reclosure device 110, such as a press-to-close or slider zipper, can include a first flange 112, a second flange 114, and one or more interlocking members 116. The interlocking members 116 can include a male member and a female member adapted for selective mating. The reclosure device 110 can be provided in line with the machine direction of the package 100 (e.g., FIGS. 1-3) and the fin seal 108 (e.g., FIGS. 4-6), or transverse to the machine direction and fin seal 108 (e.g., FIGS. 7-9). The reclosure device 110 of the present invention can be provided at or along a portion of the fin seal 108 (FIGS. 1-3), opposite the fin seal 108 (FIGS. 4-6), or anywhere else along a portion of the package 100 such that it extends out generally transverse from the plane of the panel surface. As depicted in the above-referenced figures, the reclosure device 110 is affixed to and extends out from the corresponding package panel such that it is aligned with a slit 103 or other feature to provide user access down into an opening of the package, to gain access to the package contents—such as wet wipes. The slit 103 can take on various shapes (e.g., linear, oval, circular, arcuate, rectangular, angled, etc.) and sizes. With these and the other embodiments disclosed herein, the flanges 112, 114 can be sealed directly to the package, or a separate, thinner, and/or flexible flange extension member can be included with the flanges to facilitate sealing to the package—e.g., 112*a*, 114*a*. Further, embodiments of the flanges can be constructed of a single thinner and flexible material and flange sections 112*a*, 114*a* are sealed to the inner sealant surface of the package panel (e.g., FIGS. 26 and 29).

In various embodiments, a film material 115 thinner than the flanges 112, 114 can be provided to extend out from and above an end portion of the device 110 to form a top seal.

This material 115 can be removed (e.g., cut, via a tear slit, weakened pathway, etc.) to provide access to the device 110.

Certain embodiments of the invention can include the reclosure device 110 provided or sealed behind or under a portion of the package 100 (e.g., a panel portion) such that the package 100 includes a pre-perforated material patch or section that can be removed by the user, as detailed further herein (e.g., FIGS. 30-36*c*). The user can then pull the reclosure device 110 out from behind the package material to extend outward from the package 100 for use. Other means of accessing or concealing the reclosure device 110 at or within the package 100 can be employed without deviating from the spirit and scope of the present invention.

Figure 11:
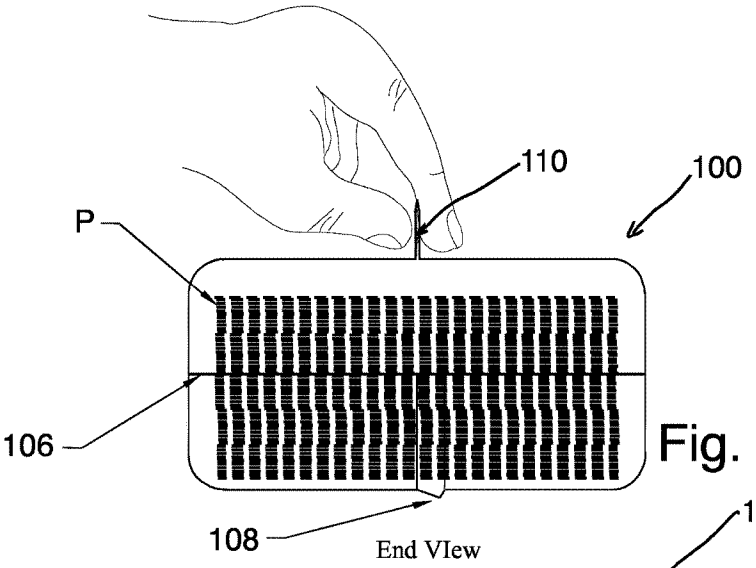
FIGS. 10-12 show use of a package having an extended or protruding reclosure device, in accordance with embodiments of the present invention.
Figure 10:
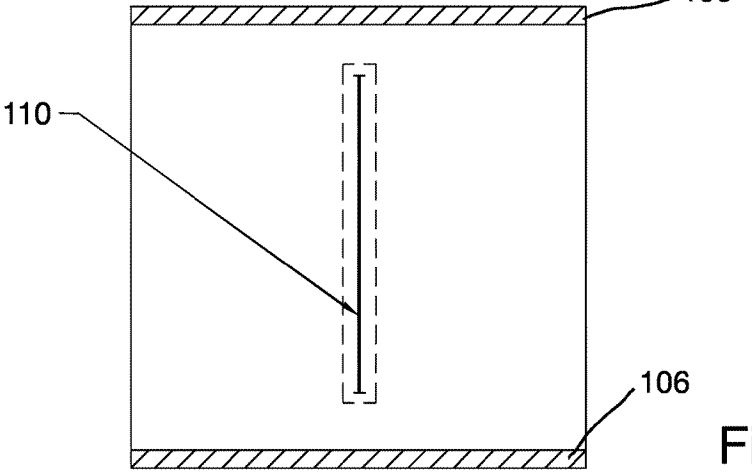
Figure 12:
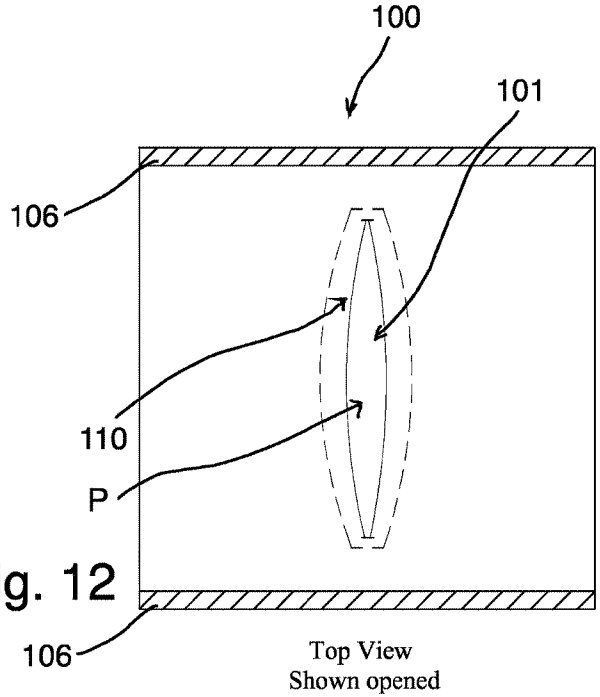

Referring to FIGS. 10-12, embodiments of the present invention are shown in use, with product P stacked inside of the package 100. A user can grasp the reclosure device 110 to gain access into or close the package 100, as shown in FIG. 11. When opened, the reclosure device 110 is spread apart at the flanges 112, 114 (disengaging the members 116) such that an opening 101 is presented for removing the product contents—e.g., wet wipes—from the package 100. Upon removing product P, the reclosure device 110 can then be closed by joining the interlocking members 116—e.g., pinching it closed, running the user's thumb and finger down the length of the device 110, sliding a sliding zipper down the length of the device 110, etc.

Figure 18:
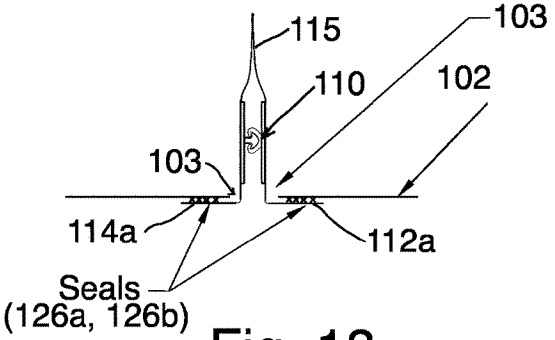
FIGS. 16-18 show partial cross-sectional views of the reclosure device of FIG. 13 placed and sealed to a package panel portion.
Figure 17:
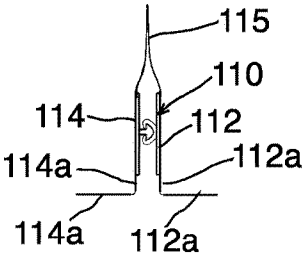
Figure 16:
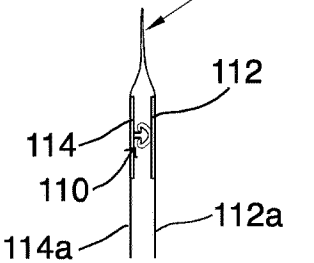
Figure 15B:
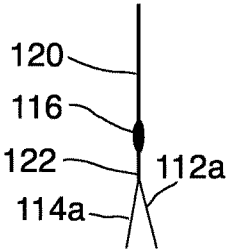
FIG. 15*b* shows a side view of the reclosure device of FIG. 13 with sealed opposing upper flange sections and hingeable lower flange sections.
Figure 13:
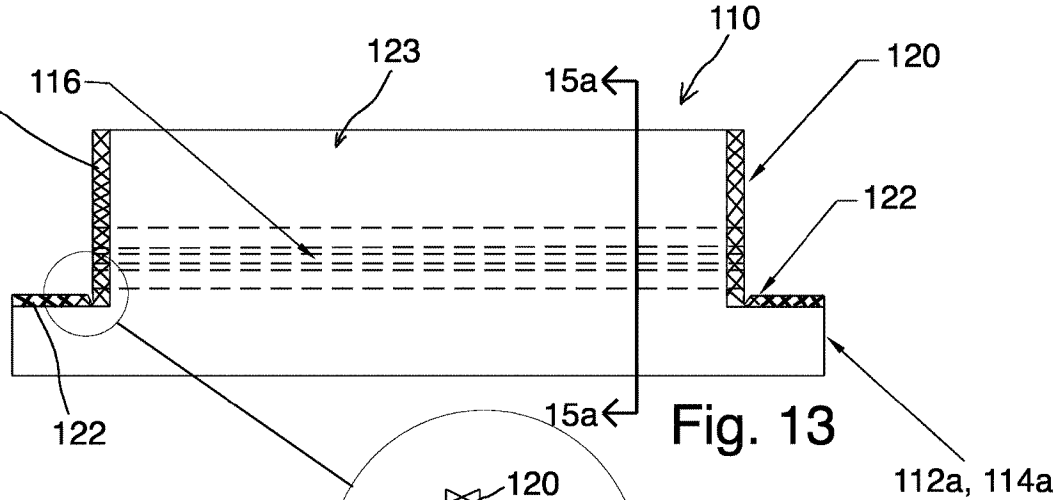
FIG. 13 shows a front view of a reclosure device having two sealed flange sections, in accordance with embodiments of the present invention.
Figure 14:
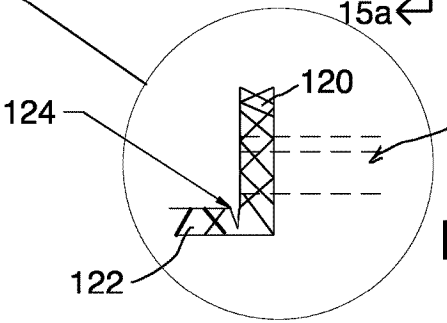
FIG. 14 shows a partial closeup view of end or edge seals of the reclosure device of FIG. 13.
Figure 15A:
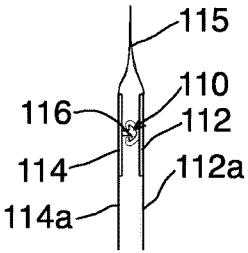
FIG. 15*a* shows a side cross-sectional view of the reclosure device of FIG. 13.

Referring to FIGS. 13-18, embodiments of the reclosure device 110 have a shoulder portion and are generally T-Shaped (e.g., FIG. 13), and can include structures and features to facilitate fixation to the package 100 and overall formation of the package 100 and device 110. The reclosure device 110 can include crush or end seal portions 120 along a side length of the device 110 to seal the edges of opposing flanges together. Sealing flange extension members or sections 112*a*, 114*a* can be provided below the locking members 116, extending from the respective flanges 112, 114, and can extend out past the width of the end portions 120 (FIG. 13). The sealing flange extensions 112*a*, 114*a*, can be constructed of a thinner and more flexible material or film than the included flanges 112, 114, or can construct or define the flanges themselves for direct sealing of the flanges to the package panel 102 or 104. As shown in the close-up view of FIG. 14, a seal 122 or like structure can be provided along a portion of the extending sealing flange section 112*a*, 114*a* to intersect with the end seal portions 120. Further, a slit, gap, or similar feature 124 can be provided at this intersecting area, on each end, such that the sealing flanges 112*a*, 114*a* can readily pivot or fold over for sealing to an inside portion of a package panel (e.g., an inside surface of panel portions 102 or 104), through the slit 103, as shown in FIGS. 17-18.

Referring to FIGS. 19-22, a method and technique of forming or manufacturing the package 100 with the extended or protruding reclosure device 110 (e.g., FIGS. 13-18) is shown. With these embodiments, a recloseable device 110, such as a press-to-close zipper or a slider zipper, is adhered to a strip of sealable barrier material, such as material 112*a*, 114*a*. This device 110, made to particular specifications in size and material type, is prepared and applied. Again, the flange can be a single piece of flexible material and does not need to be adhered to other extension pieces, thereby defining the ends of the flange itself as sections 112*a*, 114*a*.

Figures 19, 20, 21, 22:
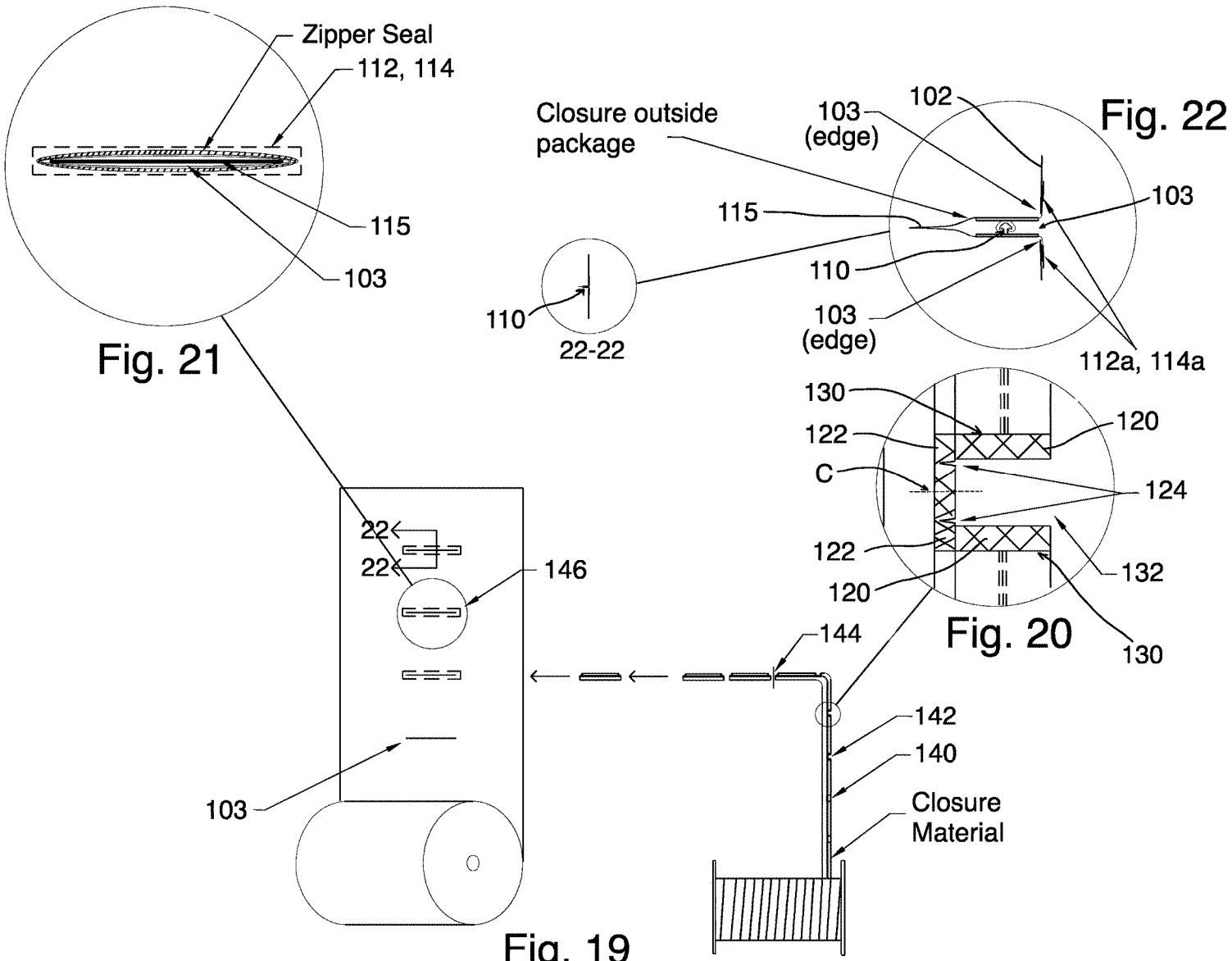
FIGS. 19-22 show extending or protruding reclosure devices and package attachment and sealing methods and structures, in accordance with embodiments of the present invention.

First, as shown in FIGS. 19-20, a continuous strip of reclosure device 110 material, before the required length of zipper is cut from the strip, includes the locking members 116 that are crushed and sealed down (step 140) at the area where it will later be cut off and separated. An additional shaped seal 130 can be formed that will end up being the right end of one seal strip section 120, 122 and the left end of another seal strip section 120, 122 when separated from the strip, as depicted in the close-up view of FIG. 20. The next step is to cut or otherwise form a notch or gap area 132 within the shaped seal area 130 of the reclosure device 110 (step 142). The notch size can vary and can be approximately ¾" wide in certain embodiments. This will later be the "shoulders" of the reclosure device piece. At the base of the notch 132, on each corner, an additional slit or gap feature 124 is made into the horizontal seal 122 of the notched area 132. This slit 124 can be over half-way through the seal 122 in certain embodiments, but will not typically extend all the way through the seal 122. Other slit or cut designs and constructs are envisioned as well to facilitate the hinging or folding described and depicted herein.

Next, the reclosure device 110 section is cut off of, or otherwise removed from, the continuous strip in the approximate center C of the notched area 132 (step 144). This will leave a section of the device 110, made to whatever length is required for the particular use, with the ends/edges of the device 110 and opposing flanges 112, 114 sealed together at seals 120 and 122 (see FIG. 15*b*). The top section 123 of this strip, where it has been notched at area 132 (e.g., FIG. 20), includes the locking members 116 of the device 110, and is the narrower section because of the notches 132 cut out earlier in the process. The bottom section, the longest portion, includes the sealing flange section 112*a*, 114*a* which will later be used to seal the reclosure device 110 to the inside of the packaging material 102.

The individual sections of the reclosure device 110 will then be presented to and sealed to the packaging material (step 146), which will later be formed into the package 100, as shown in FIGS. 19 and 21. The packaging material will require a slit or cut out/slot 103 in the location of the material where the reclosure device 110 will be placed. This slit 103 is generally slightly longer than the narrowest portion of the device section (e.g., the top section 123), and shorter than the longest section of the device, such as the bottom sealing flange extensions or sections 112*a*, 114*a*. The narrow section of the reclosure device 110 is passed or placed through the packaging material, through the slit 103, and up to the widest portion of the device 110, such as the flange sections 112*a*, 114*a*. This widest portion cannot fit through the slit 103 because of the shorter length of the slit dimension. Sections 112*a*, 114*a* of the reclosure device 110 are then pushed or folded over so they are parallel to the packaging panel material and a seal bar placed over the top of the packaging material (or elsewhere) will come down and seal the flange sections 112*a*, 114*a* of the device 110 that is nearest to the packaging material, under the material, together with the inside surface of the packaging material or corresponding package panel, such as 102 or 104 (FIG. 22). The slit or gap 124 that was placed on each end of the device flange material earlier in the process allows the flange extension sections 112*a*, 114*a* to fold over as described without the flange material kinking or defining a large mass doubled over at each end of the device—which could cause it to leak.

Figure 23:
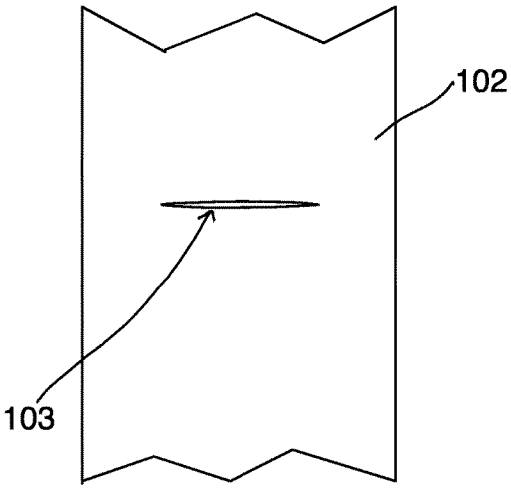
FIGS. 23-29 show a reclosure device and the method of sealing the reclosure device and the corresponding flange sections to package panel material, in accordance with embodiments of the present invention.
Figure 24:
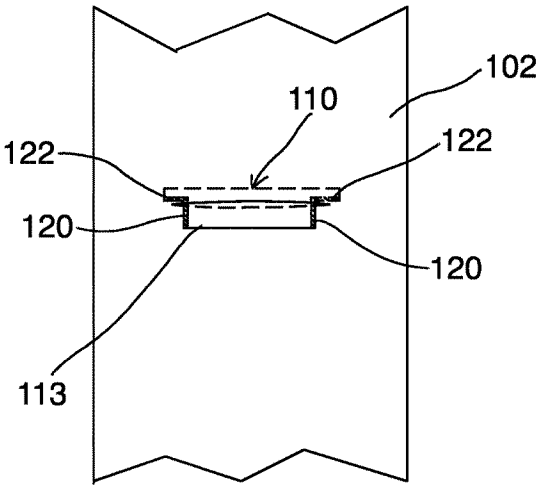

Referring to FIGS. 23-26, placement and attachment of the flanges or flange extension sections 112*a*, 114*a* is shown. FIG. 23 shows a top view of a section of the package panel film 102 (or 104) with slit 103 provided to receive the reclosure device 110. FIG. 24 shows the reclosure device 110 pushed or otherwise provided through the slit 103, e.g., via the underside or sealant side of the panel 102, such that a top portion 113 is extending out away from the panel 102.

Figure 25:
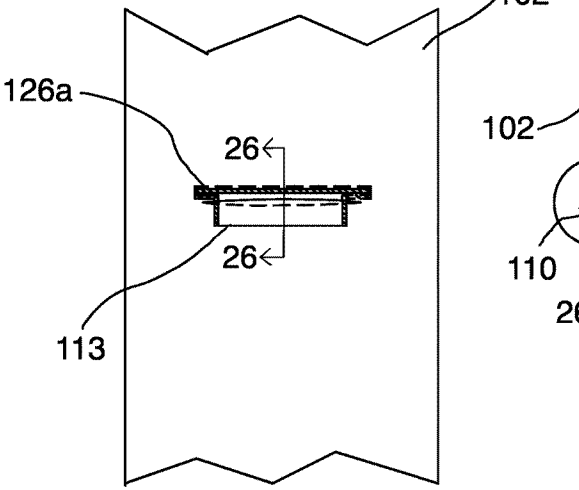
Figure 26:
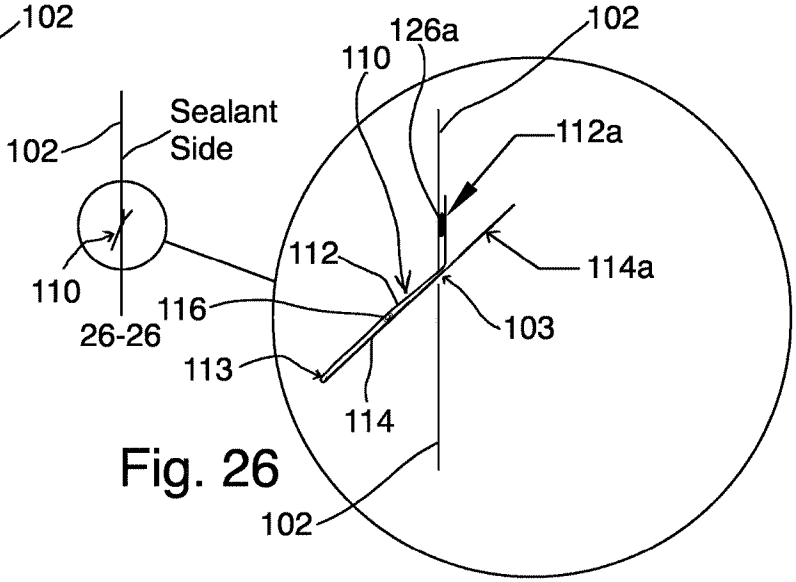

FIGS. 25-26 depict flange section 112*a* folded and sealed to the inner sealant surface of panel portion 102 at seal 126*a* such that flange section 114*a* is initially free to pivot or hinge for sealing to the inner sealant surface of panel portion 102 on the other side of the slit 103. As depicted and detailed herein, the device 110 and corresponding flanges can be formed from a single flange film, or zipper tape, such that the interlocking members 16 are provided on or sealed to the flange film. The flange film is folded at top section 113 and then sealed at seals 120 and 122 such that the flange sections 112*a*, 114*a* are sealed to the inside sealant surface (e.g., FIG. 29). This folded section 113 can replace the separate film material 115 of other embodiments and defines the top of the reclosure device 110 extending out from the package panel. Such a single-film reclosure or flange construct can be employed or implemented with any of the package 100 and reclosure device 110 and flange embodiments detailed herein. The ends of the single film flange, opposite the top portion 113, will therefore define the flange sections 112*a*, 114*a* sealable to the package panel, and the flange sections 112, 114 can simply define the portions of the flange film extending above the slit and package panel 102.

Figures 27, 28, 29:
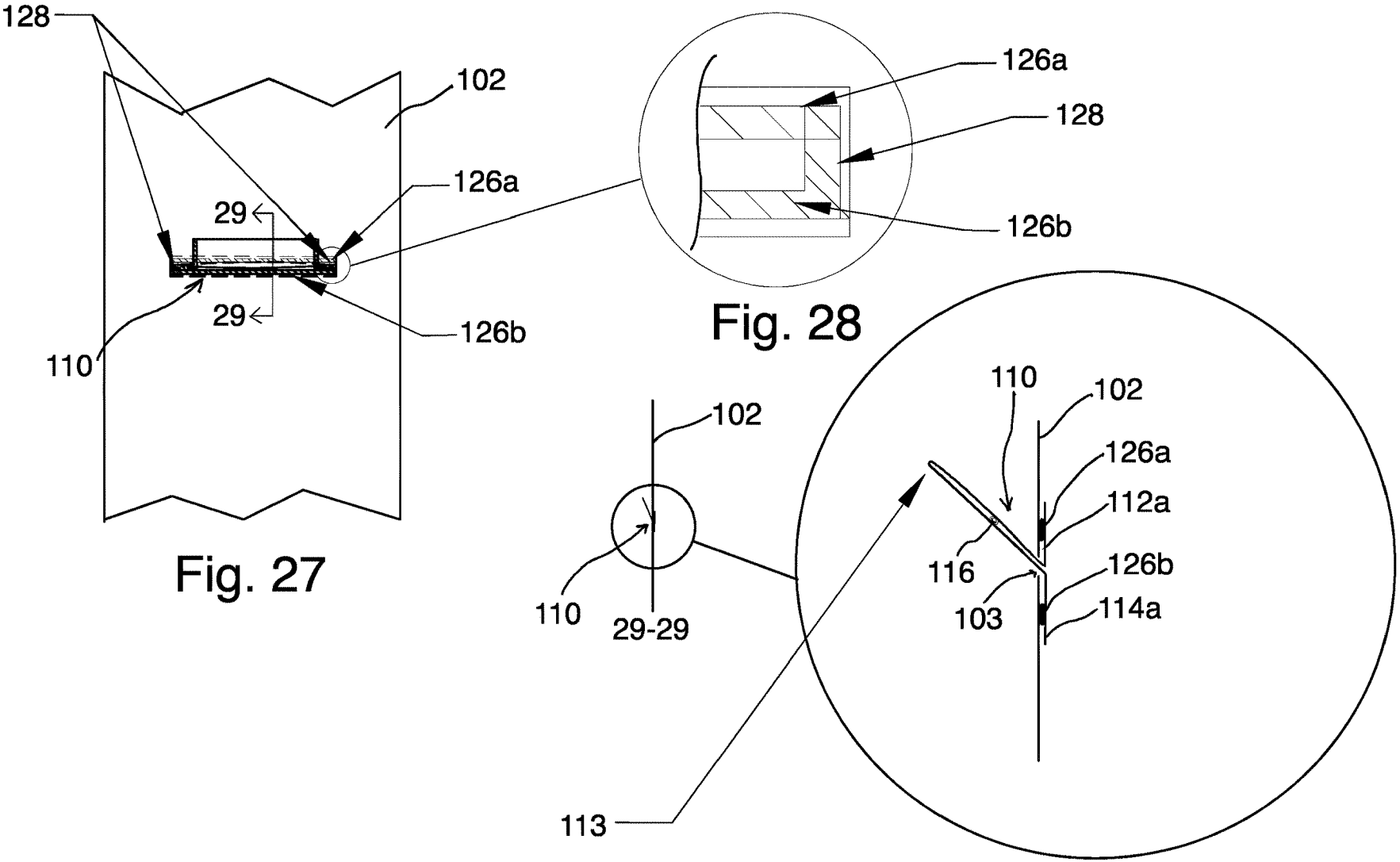
Figure 30:
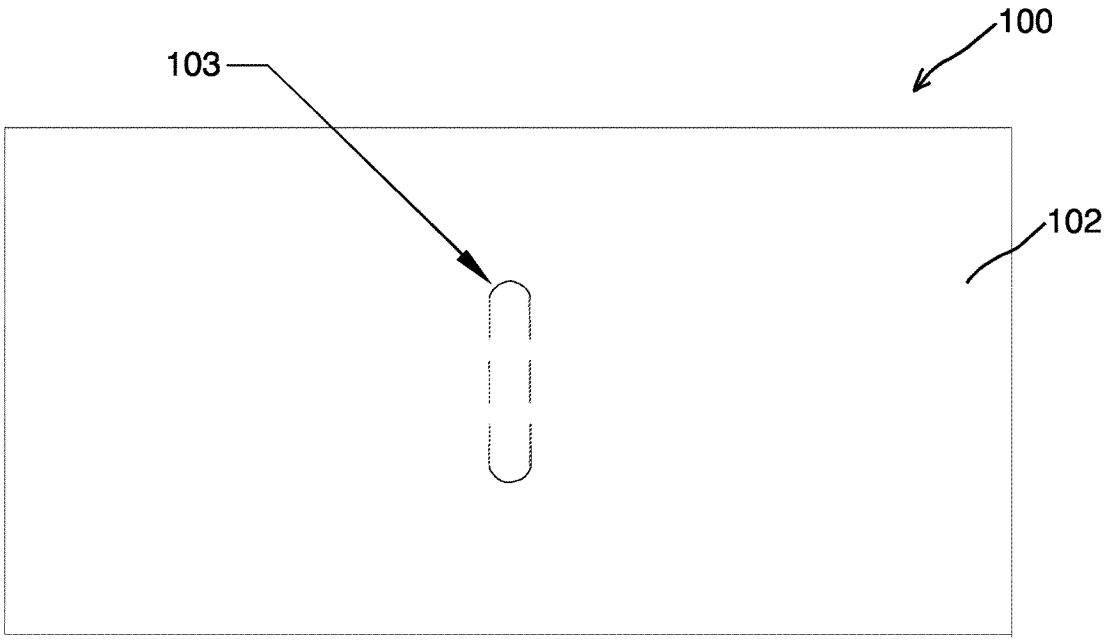
FIGS. 30-36*c* show reclosure device structures and attachment methods for initially providing the reclosure device beneath or behind package material, and later extendable outside of the package material, in accordance with embodiments of the present invention.

FIGS. 27-29 show the second flange member 114*a* sealed to the inner sealant surface of panel portion 102 at seal 126*b*, with an end or cross seal 128 extending between and transverse to the flange seals 126*a*, 126*b* at each end of the flange sections to ensure the ends of the flange sections 112*a*, 114*a* (or 112, 114) are completely sealed to the package material to eliminate the potential for leaking through or around the reclosure device 110. The folded top portion 113 can include one or more features to facilitate opening, such as a peel seal, a tear slit, a frangible section, perforations, laser scoring, a weakened pathway, etc.

The reclosure device 110 material is then completely sealed to the packaging material with no areas for air to get into the package 100, or moisture from within the package 100 to escape. The package 100 can be formed and filled with methods known to those skilled in the art. This material can be made on a roll-to-roll format to later be run on a form, fill, and seal machine, such as a flow wrapper machine, while it is being filled, or it can be made into a premade pouch to be filled and a final seal placed on it later. A myriad of sealing, crushing, notching, cutting, forming, shaping and other processes can be modified and included with embodiments of the present invention to achieve the reclosure device 110 attachment and package formation methods taught and suggested herein.

When the consumer wishes to open the package initially, they simply tear or cut off section 115 or 113 (and, if present, peel open a frangible seal) above the reclosure device 110 and open the device to access the product P within the package 100 (e.g., See FIGS. 10-12). After they retrieve some of the product P and wish to close the device 110 to keep the product P from spilling or drying out, they simply grab the device 110 that is sticking up above the package and pinch it closed, or run their thumb and fingers down the length of the device to close it. It will be accessible for opening and closing just like the top of a normal recloseable package, with the product completely underneath the members 116 so it will not hinder the closing. Other structures or features, such as a jagged or undulating section or film, can be included at the opening slit 103 to further facilitate disengaging a dispensing towelette from the next towelette, and to keep the towelette that is next to be dispensed from extending too far into the device 110 area (e.g., between the locking members 116).

Figure 31:
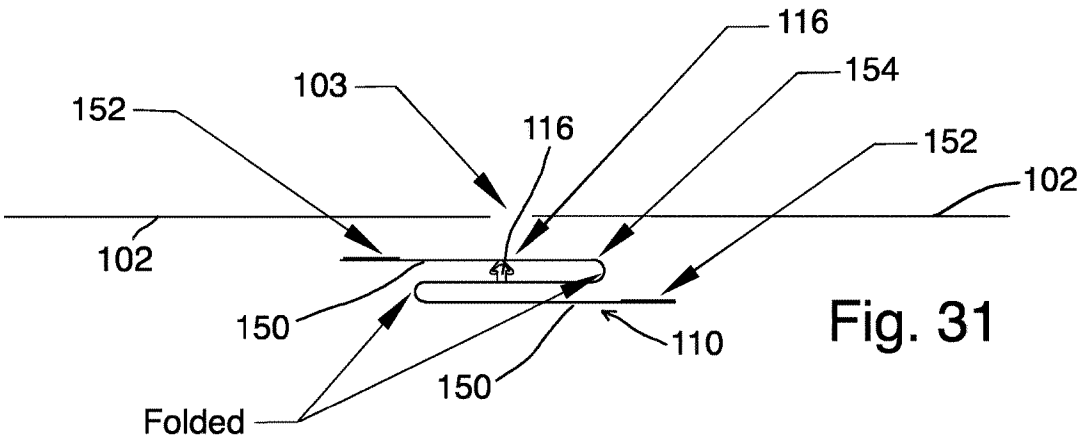
Figure 32:
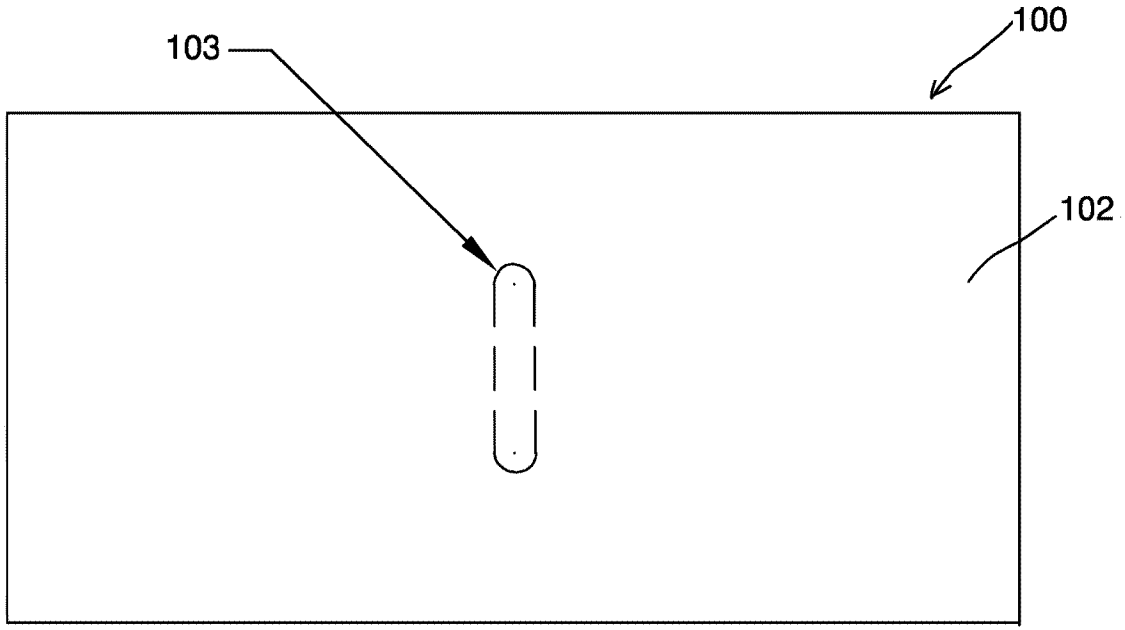
Figure 33:
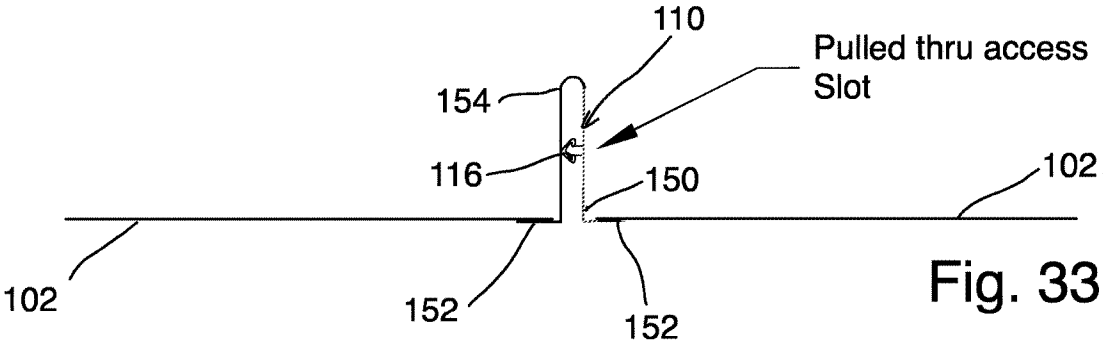

Referring to FIGS. 30-36*c*, further embodiments of the package 100 and reclosure device 110 are shown. For these embodiments, the reclosure device 110 can be initially provided below or behind a material panel portion 102 or 104, or other package film/material, and is accessible via a slot or removable slug of material at slit 103 of the package 100. The slot or slug can take on various shapes, sizes, and constructs. The reclosure device 110 includes the one or more locking members 116 (e.g., male and female) provided on a film/flange 150 constructed of a barrier or non-barrier material. Ends or other portions 152 of the film 150 are sealable to an inside surface of the package panel 102 or 104 and folded such that an extendable portion 154 is capable of being pulled or otherwise positioned through the slot 103 to extend outward from the package 100 as described herein, as shown in FIGS. 31 and 33.

Figure 34:
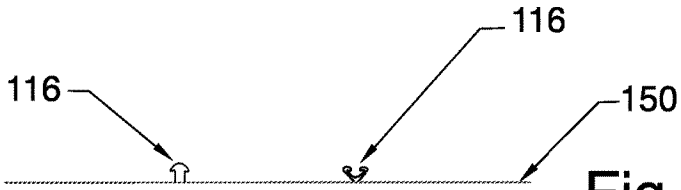
Figure 35:
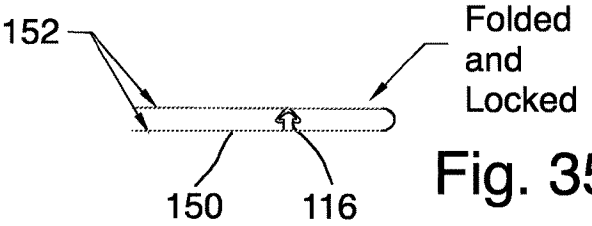

FIGS. 34-35 show the film or material 150 including the male and female locking members 116, with the material 150 folded over and mated for sealing attachment of the end portions 152 to the interior of the package panel 102 or 104.

Figure 36A:
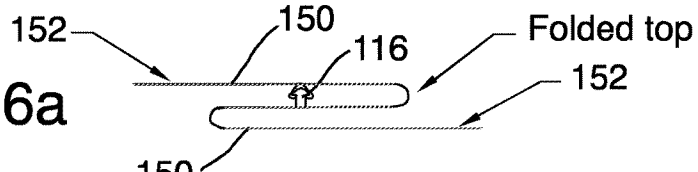
Figure 36B:
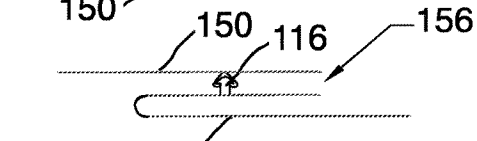
Figure 36C:
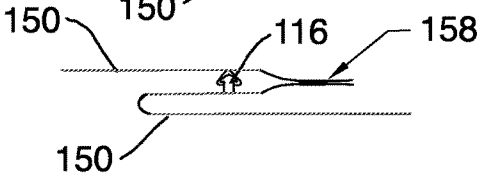

FIGS. 36*a*-36*c* show various embodiments of the reclosure device 110, including a two-piece design with a break or gap 156 provided along the film 150 (FIG. 36*b*), and a reclosure device 110 with a frangible portion or peel seal 158 to facilitate access and use (FIG. 36*c*).

While various embodiments of the reclosure device 110 show one or more flanges 112, 114 attached to separate and distinct film materials 112*a*, 114*a*, any of the devices 110 shown or described herein can comprise the locking members 116 simply provided or otherwise attached directly to the flanges 112, 114, or to the extension flange material 112*a*, 114*a* (e.g., without separate flanges 112, 114). That film material 112*a*, 114*a* would then be attached to the package panel portion 102 to provide the extending or extendable reclosure device 110 of the present invention.

The package 100 including the recloseable device 110 according to the invention can include packages constructed, in whole or in part, of flexible, rigid, semi-rigid, or semi-flexible materials or panels. Briefly, the package panel portions are generally constructed of flexible sheet material such as polyethylene, polyester, metal foil, polypropylene, or polyethylenes or polypropylenes laminated with other materials such as nylon, polyester, and like films. To provide for increased barrier properties, embodiments can use composite or laminate layers of said materials and material of the like. Generally, in such composite or laminate embodiments, a material having preferred sealing characteristics can be joined, bonded or laminated to a material having a different preferred characteristic (e.g., beneficial oxygen barrier properties). Regardless, single sheets, composites/laminates, and a myriad of other materials and techniques known to one skilled in the art may be implemented based on particular usage and manufacturing needs without deviating from the spirit and scope of the present invention. The present invention in certain embodiments permits the flexible package to be made using less expensive or cheaper materials than would otherwise be necessary.

In various embodiments, the panel portions will be formed of one contiguous web material. In other embodiments, at least one of the panel portions can be distinct web materials joined or sealed to other respective panel portions to form the package of the present invention.

The present invention may be embodied in other specific forms without departing from the spirit or essential attributes thereof, and it is, therefore, desired that the present embodiment be considered in all respects as illustrative and not restrictive. Similarly, the above-described methods and techniques for forming the present invention are illustrative processes and are not intended to limit the methods of manufacturing/forming the present invention to those specifically defined herein. Various unspecified steps and procedures can be performed to create or form the inventive packages and devices. Further, features and aspects of the various embodiments described herein can be combined to form additional embodiments within the scope of the invention even if such combination is not specifically described herein.

References to front and back panel portions for the package 100 and package formation embodiments described herein are provided to facilitate an understanding of orientation and direction and are not intended to be limiting. For instance, reclosure devices, seals, and other structures or portions of the package, can be provided to or along any portion of the package 100 regardless of the references herein to front, back, side, bottom and the like.

What is claimed is:

1. A package, comprising:

a first panel portion, a second panel portion, and an interior package cavity, wherein the first panel portion and the second panel portion define an interior surface and a package width;

an access opening provided along a portion of the first panel portion and having first and second opening end portions; and a reclosure device including:

first and second longitudinal end seal portions defining a body portion therebetween; and first and second shoulder flange portions extending out transverse from and past the first and second longitudinal end seal portions, wherein the first longitudinal end seal portion is affixed to the first opening end portion, the second longitudinal end seal portion is affixed to the second opening end portion, and end portions of the first and second shoulder flange portions are affixed to the interior surface, transverse to the first and second longitudinal end seal portions and adjacent the access opening such that the end portions of the first and second shoulder flange portions terminate a distance shorter than the package width, to define a perimeter seal around the access opening, with a portion of the body portion extending transverse from and outside of the first panel portion at the access opening.

2. The package of claim 1, further including a first extending flange member and a second extending flange member, the first extending flange member constructed of a thinner material than, and extending from, the first shoulder flange portion and the second extending flange member constructed of a thinner material than, and extending from, the second shoulder flange portion.

3. The package of claim 1, further including a fin or lap seal, wherein the access opening is provided in the same direction as the fin or lap seal.

4. The package of claim 1, further including a fin or lap seal, wherein the access opening is provided transverse to the direction of the fin or lap seal.

5. The package of claim 1, wherein the reclosure device includes a female locking member and a male locking member.

6. The package of claim 1, wherein the reclosure device is a press-to-close zipper device or a slider zipper device.

7. The package of claim 1, wherein the access opening is defined by a slit.

8. The package of claim 1, wherein the reclosure device is generally T-shaped.

9. The package of claim 1, wherein the reclosure device includes opposing gap features to facilitate hinging of the first and second shoulder flange portions.

10. The package of claim 1, wherein the portion of the body portion of the reclosure device extending transverse from and outside of the first panel portion includes a removable end portion.

11. The package of claim 10, wherein the removable end portion includes a tear slit.

12. The package of claim 1, wherein the reclosure device includes a frangible seal.

13. The package of claim 1, wherein the reclosure device includes a peel seal.

14. The package of claim 1, wherein the reclosure device includes a weakened pathway.

15. The package of claim 1, wherein the reclosure device includes a plurality of locking members.

16. The package of claim 1, wherein the first and second shoulder flange portions each include one or more seals intersecting with the first or second longitudinal end seal portions.

17. A pouch, comprising:

a first panel portion, a second panel portion, and an interior pouch cavity, wherein the first panel portion includes an interior surface, and wherein the first panel portion defines a package width;

an access opening provided along a portion of the first panel portion and having first and second opening end portions defined in the first panel portion; and a reclosure device including:

first and second longitudinal end lengths defining a body portion therebetween; and a shoulder portion having first and second sealing flange elements extending out transverse from the first and second longitudinal end lengths, wherein the first flange sealing element is positioned transverse to the first longitudinal end length at a first portion of the interior surface adjacent the access opening and the second flange sealing element is positioned transverse to the second longitudinal end length at a second portion of the interior surface adjacent the access opening such that the first and second sealing flange elements terminate short of the package width, and wherein the first longitudinal end length is sealed to the first opening end portion, the second longitudinal end length is sealed to the second opening end portion, and end portions of the first and second sealing flange elements are sealed to the interior surface to define a perimeter seal around the access opening, with a portion of the body portion extending transverse from and outside of the first panel portion at the access opening.

18. The pouch of claim 17, wherein the reclosure device is a zipper device.

19. The pouch of claim 17, wherein the reclosure device includes a plurality of locking members.

* * * * *